US005738238A

United States Patent [19]

Yang

[11] Patent Number: 5,738,238

[45] Date of Patent: Apr. 14, 1998

[54] CONTAINER FOR PRESERVING FOOD

[76] Inventor: Hsiu-Jen Yang, No. 20, Pei Pao I St., Jen Te Shiang, Tainan Hsien, Taiwan

[21] Appl. No.: 728,172

[22] Filed: Oct. 9, 1996

[51] Int. Cl.[6] ..... B65D 51/16

[52] U.S. Cl. ..... 220/337; 220/324; 220/344; 16/386; 16/267

[58] Field of Search ..... 220/337, 334, 220/324, 344; 215/237; 16/386, 267

[56] References Cited

U.S. PATENT DOCUMENTS

| | | | |
|---|---|---|---|
| 2,734,222 | 2/1956 | Kiba | 16/267 X |
| 3,126,120 | 3/1964 | Crate | 16/267 X |
| 5,385,257 | 1/1995 | Hung | 220/337 X |

*Primary Examiner*—Jes F. Pascua
*Attorney, Agent, or Firm*—Bacon & Thomas

[57] ABSTRACT

A container for preserving food including a container body, a detachable container cover for covering the container body, and a detachable fastener for securing the container body and the container cover together in the closed condition, wherein the container body has a first pair of pivot pins and a second pair of pivot pins respectively aligned at two opposite sides; the container cover has a pair of axle receptacles raised from the periphery and coupled to the second pair of pivot pins of the container body, and a hook raised from the periphery opposite to the axle receptacles; the fastener includes a hook plate having a hook at one end adapted for hooking on the hook of the container body and a transverse pivot at an opposite end, and an actuating plate having a first pair of recessed holes pivotably coupled to the transverse pivot of the hook plate by press fit and a second pair of recessed holes pivotably coupled to the first pair of pivot pins of the container body by press fit.

1 Claim, 6 Drawing Sheets

CONTAINER FOR PRESERVING FOOD

BACKGROUND OF THE INVENTION

The present invention relates to containers for preserving food, and relates more particularly to such a container in which the container cover and the container body can be separated from each other.

Various containers and pots have been disclosed for preserving food, and have appeared on the market. FIG. 5 shows a prior art container for this purpose. This structure of container comprises a container cover 51 and a container body 52 respectively injection-molded from plastic. The container cover 51 is fixedly mounted with a metal loop 53. The metal loop 53 has a hooked portion 531. The container body 52 is fixedly mounted with a snap hook 54 controlled to hook up with the hooked portion 531 of the metal loop 53 of the container cover 51. This structure of container is complicated to manufacture. When the container cover 51 and the container body 52 are respectively injection-molded from plastic, the metal loop 53 and the snap hook 54 must be separately fastened to the container cover 51 and the container body 52, and then the metal loop 53 is pivoted to the container body 52. This complicated manufacturing procedure greatly increase the manufacturing cost of the container. Another drawback of this structure of container is that the metal elements tend to be covered with rust. Furthermore, when the container is assembled, the container cover cannot be detached from the container body. When the container cover is opened, the center of gravity of the container is shifted sideways from the center of the container body to the border area, therefore the container tends to fall from the standing position.

The pot with improved configuration of U.S. Pat. No. 5,385,257, as shown in FIG. 6, comprises a lid 61, a pot body 62, and a fastener 63 which are all made from plastic material. The fastener 63 is comprised of a positioning plate 631 and a clipping plate 632. The lid 61 has a positioning block 611 at one end and a retaining block 612 at the other end. A receiving support 521 is disposed at the top portion of the pot body 62. The retaining block 612 of the lid 61 is pivoted to the receiving support 621 by a pin 64. The pot body 62 further comprises a pivoting block 622 and a stopping plate 623 at the circumference. The positioning plate 631 and the clipping plate 632 are pivoted to the pot body 62 by a pair of pins 65, 66. When the pot is assembled, the lid 61 cannot be detached from the pot body 62. Therefore, when the lip 61 is opened, the pot body 62 tends to be forced to fall from the standing position.

SUMMARY OF THE INVENTION

The present invention has been accomplished to provide a container for preserving food which eliminates the aforesaid drawbacks. It is one object of the present invention to provide a container for preserving food which permits the container cover to be detached from the container body for easy cleaning. It is another object of the present invention to provide a container for preserving food which is inexpensive to manufacture, and easy to assemble. According to the preferred embodiment of the present invention, the container comprises a container body, a detachable container cover for covering the container body, and a detachable fastener for securing the container body and the container cover together in the closed condition. The container body, the container cover, and the fastener are respectively molded from plastic material. The container body has a first pair of pivot pins and a second pair of pivot pins respectively aligned at two opposite sides. The container cover has a pair of axle receptacles raised from the periphery and coupled to the second pair of pivot pins of the container body, and a hook raised from the periphery opposite to the axle receptacles. The fastener comprises a hook plate having a hook at one end adapted for hooking on the hook of the container body and a transverse pivot at an opposite end, and an actuating plate having a first pair of recessed holes pivotably coupled to the transverse pivot of the hook plate by press fit and a second pair of recessed holes pivotably coupled to the first pair of pivot pins of the container body by press fit.

DETAILED DESCRIPTION OF THE PREFERRED EMBODIMENT

Figure 1:
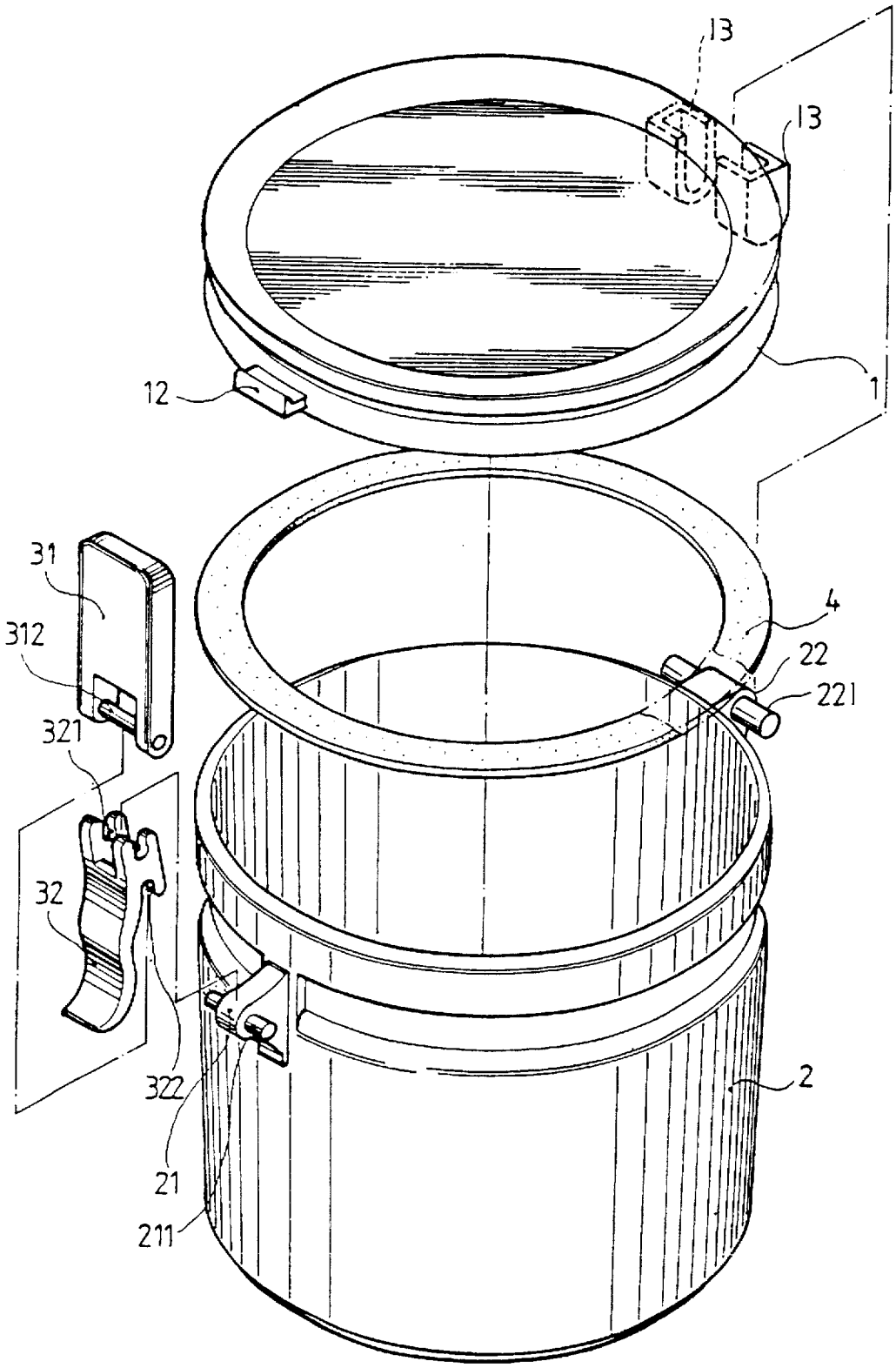
FIG. 1 is an exploded view of a container for preserving food according to the present invention.

Referring to Figures from 1 to 4, a sealed container in accordance with the present invention is generally comprised of a top-open container body 2, a container cover 1, and a fastener 3. The container cover 1 is made in integrity having a downward flange 11 at the bottom mounted with a packing ring 4 for sealing the top opening of the container body 2, a hook 12 and a pair of symmetrical axle receptacles 13 raised from the periphery at two opposite sides. The axle receptacles 13 are spaced from each other by a space. The top-open container body 2 is a cylindrical top-open case, comprising a first projecting block 21 and a second projecting block 22 respectively raised from the periphery near the top opening at two opposite sides, a first pair of pivot pins 211 raised from two opposite sides of the first projecting block 21, and a second pair of pivot pins 221 raised from two opposite sides of the second projecting block 22 and adapted inserting into the space defined between the axle receptacles 13. The fastener 3 is comprised of a hook plate 31, and an actuating plate 32. The hook plate 31 comprises a hook 311 at an inner side near the top, and a transverse pivot 312 at the bottom. The actuating plate 32 comprises a first pair of transversely aligned recessed holes 321 press-fit into engagement with the transverse pivot 312 of the hook plate 31 for permitting the actuating plate 32 to be turned about the transverse pivot 312 of the hook plate 31, and a second pair of transversely aligned recessed holes 322 adapted for pivotably coupling to the first pair of pivot pins 211 of the first projecting block 21 of the container body 2 by press fit.

Figure 2:
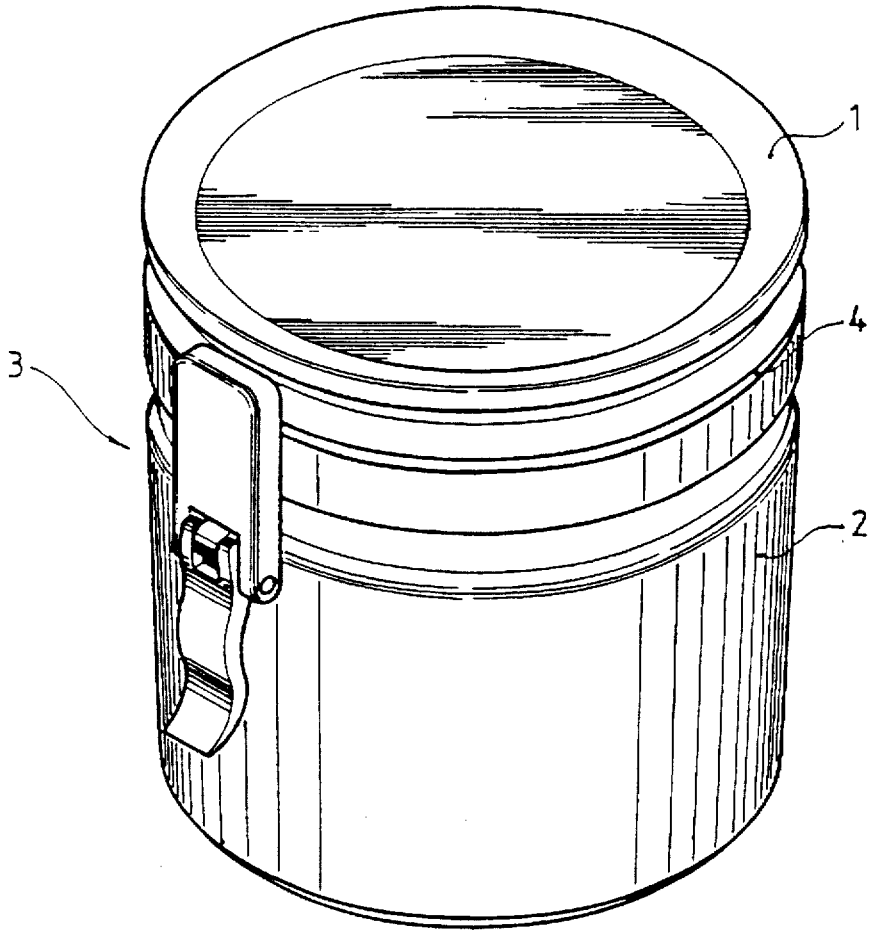
FIG. 2 is an elevational view of the container shown in FIG. 1.

Referring to FIGS. 1 and 2 again, the axle receptacles 13 of the container cover 1 are coupled to the second pair of pivot pins 221 of the second projecting block 22 of the container body 2, permitting the second pair of pivot pins 221 to be turned in the axle receptacles 13, thus the container cover 1 can be turned about the second pair of pivot pins 221 and closed on the container body 2. When the second pair of transversely aligned recessed holes 322 are press-fit into engagement with the first pair of pivot pins 211 of the first projecting block 21 of the container body 2, the container cover 1 is closed on the container body 2 and the hook 311 of the hook plate 31 is hooked on the hook 12 of the container cover 1, and then the actuating plate 32 is turned downwards and closely attached to the container body 2 to pull the hook plate 31 downwards, causing it to hold down the container cover 1.

Figure 3:
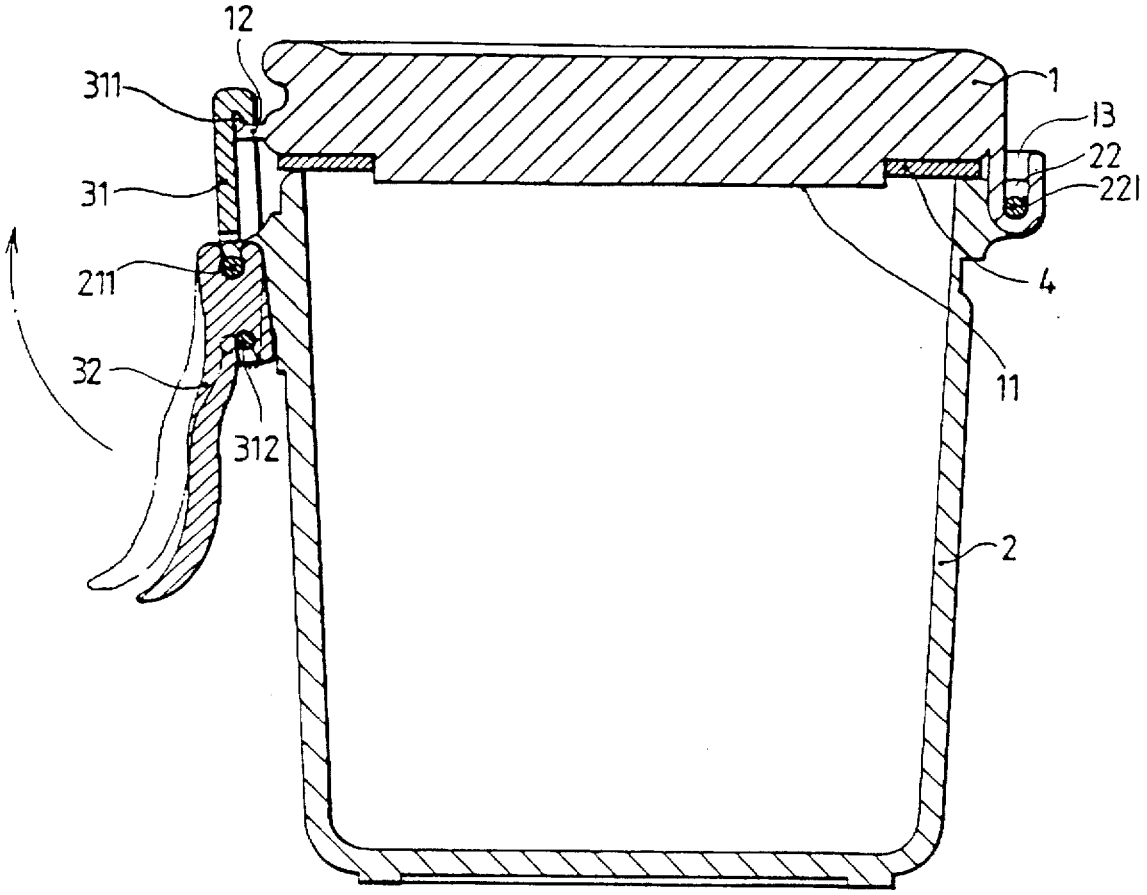
FIG. 3 is a sectional view of the present invention, showing the actuating plate turned upwards.
Figure 4:
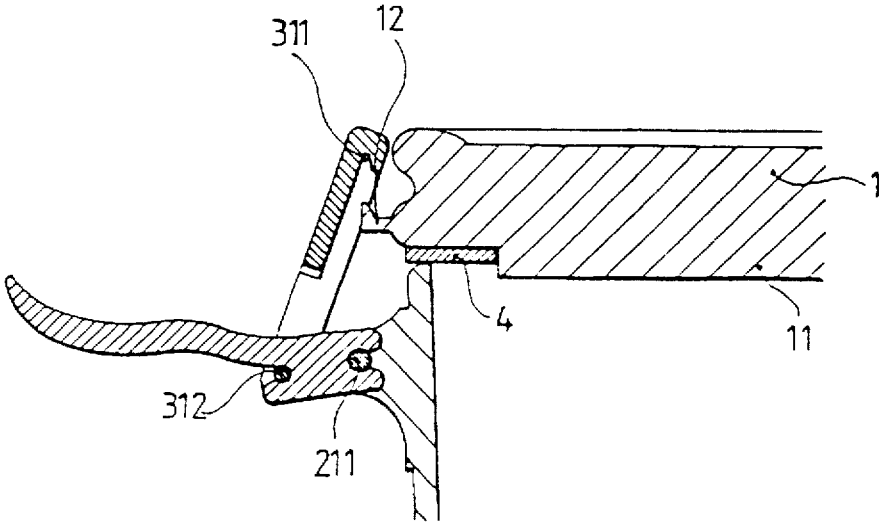
FIG. 4 is a partial view in section of the present invention, showing the actuating plate lifted, and the hook plate disengaged from the hook of the container cover.
Figure 5:
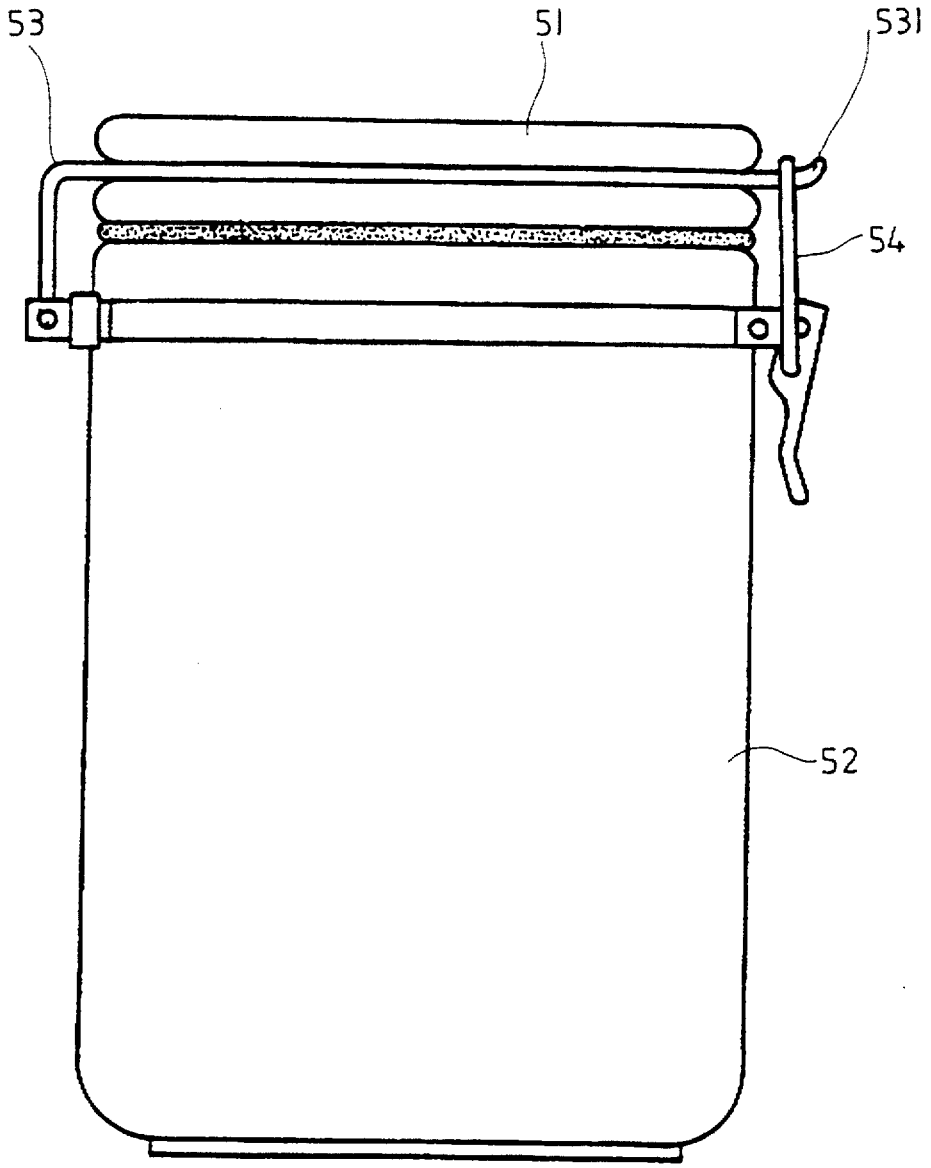
FiG 5 PRIOR ART
FIG. 5 shows a container for preserving food according to the prior art.
Figure 6:
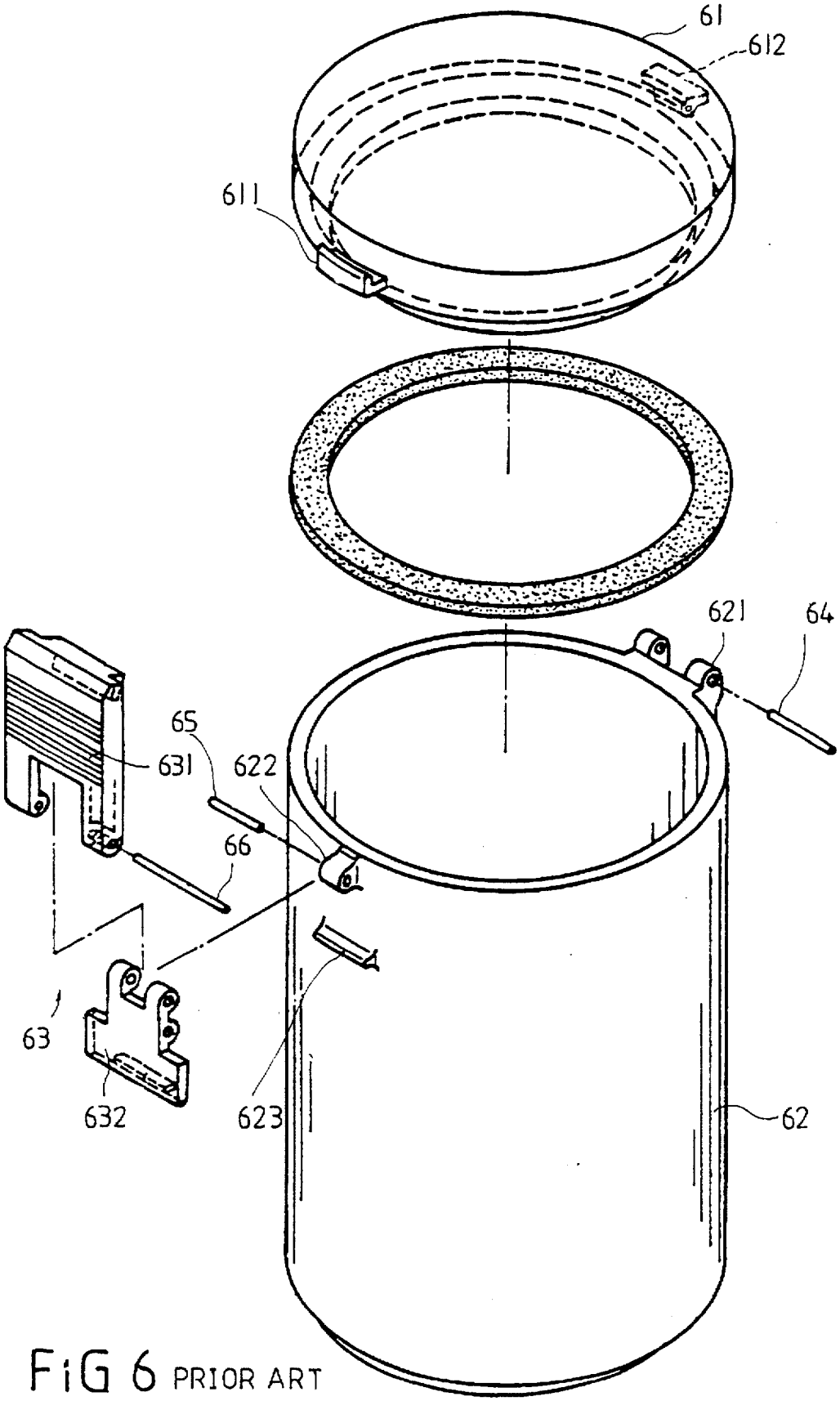
FiG 6 PRIOR ART
FIG. 6 shows a pot with improved configuration according to U.S. Pat. No. 5,383,257.

Referring to FIGS. 3 and 4 again, when the actuating plate 32 is turned upwards to release the hook plate 31 from the hook 12 of the container cover 1, and therefore the container cover 1 can be opened from the container body 2.

When not in use, the actuating plate 32 can be detached from the first pair of pivot pins 211 of the first projecting block 21 of the container body 2, the axle receptacles 13 of the container cover 1 can be detached from the second pair of pivot pins 221 of the second projecting block 22 of the container body 2, thus the parts of the sealed container are separated from one another for easy cleaning.

While only one embodiment of the present invention has been shown and described, it will be understood that various modifications and changes could be made thereunto without departing from the spirit and scope of the invention disclosed.

What the invention claimed is:

1. A sealed container comprising:

a container body having a first projecting block and a second projecting block respectively raised from the periphery near a top opening thereof at two opposite sides, a first pair of pivot pins raised from two opposite sides of said first projecting block, and a second pair of pivot pins raised from two opposite sides of said second projecting block;

a container cover adapted for covering on the top opening of said container body, having a downward flange raised from a bottom side thereof and mounted with a packing ring for sealing the top opening of said container body, a hook and a pair of symmetrical axle receptacles raised from the periphery at two opposite sides, said axle receptacles being spaced from each other and coupled to the second pair of pivot pins of the second projecting block of said container body for permitting said container cover to be turned thereabout; and, a fastener pivoted to the first pair of pivot pins of the first projecting block of said container body and controlled to hook up with the hook of said container cover, said fastener comprising a hook plate and an actuating plate, said hook plate comprising a hook near a top side thereof adapted for hooking on the hook of said container cover to hold it down, and a transverse pivot at a bottom side thereof, said actuating plate comprising a first pair of transversely aligned recessed holes press-fit into engagement with the transverse pivot of said hook plate for permitting said actuating plate to be turned about the transverse pivot of said hook plate, and a second pair of transversely aligned recessed holes press-fit into engagement with the first pair of pivot pins of the first projecting block of said container body for permitting said actuating plate to be turned about the first pair of pivot pins of the first projecting block of said container body.

* * * * *